US006645433B2

(12) United States Patent
Homberg et al.

(10) Patent No.: US 6,645,433 B2
(45) Date of Patent: Nov. 11, 2003

(54) ERGONOMIC RETURN SPRINGLESS MANUAL AIR DISPLACEMENT PIPETTE

(75) Inventors: William D. Homberg, Oakland, CA (US); James S. Petrek, Danville, CA (US); Kenneth Rainin, Piedmont, CA (US)

(73) Assignee: Rainin Instrument, LLC, Oakland, CA (US)

( * ) Notice: Subject to any disclaimer, the term of this patent is extended or adjusted under 35 U.S.C. 154(b) by 47 days.

(21) Appl. No.: 10/090,924

(22) Filed: Mar. 4, 2002

(65) Prior Publication Data

US 2002/0081234 A1 Jun. 27, 2002

Related U.S. Application Data

(63) Continuation-in-part of application No. 09/522,257, filed on Mar. 9, 2000, now Pat. No. 6,352,673.

(51) Int. Cl.[7] ..... B01L 3/02

(52) U.S. Cl. ..... 422/100; 73/864.13; 73/864.16; 73/864.18

(58) Field of Search ..... 422/100; 73/864.01, 73/864.11, 864.13, 864.16, 864.18

(56) References Cited

U.S. PATENT DOCUMENTS

| | | | | | |
|---|---|---|---|---|---|
| 3,882,729 | A | * | 5/1975 | Roach | 73/864.18 |
| 4,041,764 | A | * | 8/1977 | Sabloewski et al. | 73/864.14 |
| 4,056,360 | A | * | 11/1977 | Risch | 73/864.17 |
| 5,347,878 | A | * | 9/1994 | Suovaniemi | 73/864.18 |
| 5,700,959 | A | * | 12/1997 | Homberg | 73/864.16 |
| 5,792,424 | A | * | 8/1998 | Homberg et al. | 422/100 |
| 6,352,673 | B1 | * | 3/2002 | Rainin et al. | 422/100 |

* cited by examiner

*Primary Examiner*—Jan Ludlow
(74) *Attorney, Agent, or Firm*—Robert R. Meads

(57) ABSTRACT

An ergonomic, manually precisely controllable return springless air displacement pipette relying upon the friction of a piston seal to maintain a plunger unit of the pipette in any axial location established by a user of the pipette.

3 Claims, 4 Drawing Sheets

ERGONOMIC RETURN SPRINGLESS MANUAL AIR DISPLACEMENT PIPETTE

RELATED APPLICATION

This application is a continuation-in-part of U.S. patent application Ser. No. 09/522,257 filed Mar. 9, 2002 which on Mar. 5, 2002 issued as U.S. Pat. No. 6,352,673.

BACKGROUND

The present invention relates to manual air displacement pipettes and, more particularly, to an ergonomic, precision, low operating force, manual air displacement pipette which is free of any return spring and the operating forces associated therewith.

U.S. Pat. Nos. 3,827,305 and 4,909,991, for example, describe commercially available single channel manual air displacement pipettes. Each such pipette includes an elongated hand-holdable pipette body housing an upwardly spring biased plunger unit. The plunger unit is supported for axial movement in the pipette body between upper and lower stop positions.

In use, a pipette user grips the pipette body with his or her thumb over an exposed upper end of the plunger unit. Downward thumb action on the plunger unit moves the plunger unit downward from its upper stop position against the upward bias of a return spring to the lower stop position at which all fluid is expelled from a tip secured to the pipette. Adjacent the lower stop position is a "home" position for the plunger unit to which the plunger unit is returned by the pipette user at the beginning of each aspiration operation with the pipette.

In the commercially available pipettes described in the foregoing patents, the home position is defined by a "soft" stop. As described in such patents, the soft stop comprises a relatively stiff "blow out" spring mechanism within the pipette body which is activated when the plunger unit reaches the home position. In this regard, and as depicted in FIG. 9*a* herein, as the pipette user manually moves the plunger unit from its upper stop position by pressing downwardly with his or her thumb on the exposed end of the plunger unit, the pipette user can "feel" an increased resistance to movement of the plunger unit associated with an activation of the blow out spring assembly opposing further downward movement of the plunger unit. The position of the plunger unit where the user feels the activation of the blow out spring mechanism defines the home position for the plunger unit. Continued movement of the plunger unit beyond the home position to the lower stop position is resisted by a combination of the return spring and the blow out spring mechanism.

The above described accurate sensing of the start of the increase in the downward force required to move the plunger unit is a delicate operation requiring great care to be exercised by the pipette user. Thus, with his or her thumb on top of the exposed end of the plunger unit, the user very carefully senses and then manually maintains the plunger unit at the home position. In practice, a significant portion of the total time associated with a pipeting operation is occupied by the pipette user manually maintaining the plunger unit at the home position ready for insertion of a tip extending from the pipette into a liquid which is to be aspirated by the pipette. Then, with the tip inserted in the liquid, the user manually controls the rate of return of the plunger unit from the home position to the upper stop position to aspirate a selected volume of the liquid into the tip secured to the pipette.

For accuracy and repeatability of operation of the pipette, it is important that the pipette user always bring the plunger unit to the exact same home position and that the pipette user manually control the rate of return of the plunger unit to the upper stop position in a repeatable manner for each pipette operation. This is necessary in order that the same desired volume of liquid will be drawn into the pipette tip during each repeated operation. It should be appreciated that such manual operation of a pipette places substantial physical and mental strain upon the pipette user over the course of a series of pipette operations wherein repeatability of operation is essential. In extreme cases, the physical hand and wrist strain associated with extensive and prolonged manual pipette operation can contribute to or produce repetitive strain injuries such as tendinitis and carpel tunnel syndrome.

To reduce the operating and static forces associated with commercial manual pipettes and to reduce the risk of repetitive strain injuries, the assignee of the present invention has recently developed and commercially introduced new manual air displacement pipettes incorporating latch mechanisms operable at the home position and magnet assist mechanisms operable as the plunger unit of a manual air displacement pipette approaches the home position to aide in locating and maintaining the plunger unit at the home position. Such new pipettes are fully described and illustrated in U.S. Pat. Nos. 5,364,596 and 5,700,959 assigned to the assignee of the present invention and incorporated herein by this reference.

To further reduce the operating and static forces associated with manual air displacement pipettes, employees of the assignee of the present invention have just developed a blow out springless air displacement manual air displacement pipette including a mechanical assist for aiding in the locating and maintenance of the associated plunger unit at its home position. That development is described and illustrated in U.S. patent application Ser. No. 09/522,256, now U.S. Pat. No. 6,365,110 assigned to the assignee of the present invention.

To still further reduce the operating and static forces associated with the operation of a manual air displacement pipette, and pursuant to the present invention, a new highly ergonomic pipette has been developed which eliminates the return spring included in all prior manual air displacement pipettes and which in certain embodiments also includes a very weak blow out spring or, in the alternative, eliminates entirely the blow out spring included in all commercial manual air displacement pipettes.

As will be described hereafter, the elimination of the return spring places the plunger unit of the manual air displacement pipette of the present invention under the total control of the pipette user who can then with minute precision and with the use of minimal thumb or finger forces accurately control the upward and downward movement and location of the plunger unit during both liquid aspiration and dispensing operations, all free of the continuous upward forces of a conventional return spring. So precise is the operation of the pipette that even the tip of a drop of liquid can be easily aspirated and dispensed thereby.

Further, with the pipette of the present invention, the rate of upward and downward movement of the plunger unit is within the complete manual control of the pipette user. By the proper manual control of the rate of piston movements, problems associated with "fountaining" and the "aerosols" caused by too rapid movement of the plunger unit in conventional manual air displacement can be eliminated.

Still further, in the manual air displacement pipette of the present invention, the only force opposing user initiated axial movement of the plunger unit may be the piston seal which creates the necessary fluid tight seal around the piston of the plunger unit. Such seal friction is sufficient to hold the plunger unit in any axial position where it is located by the pipette user. Thus, for example, in the pipette of the present invention, once the pipette user manually moves the plunger to the home position, no further forces need be generated by the user to maintain the plunger unit at the home position.

Further, the seal friction force is so low that the upward thumb or finger force which must be generated by the pipette user to move the plunger from the home position to the upper stop position during aspiration of a selected volume of liquid or the downward force which must be generated to move the plunger unit to the lower stop position to dispense the selected volume of liquid from the pipette tip secured thereto, is absolutely minimal.

Also, during any such upward or downward plunger unit movement, the user may halt the movement of the plunger and it will remain at that location for adjustment by the user as during precision pipetting of minute liquid sample or the layering of gels or the loading of electrophoresis plates or during any one of the several different modes of operation of the pipette, e.g. titration, measurement, multiple dispense and the like.

SUMMARY OF THE INVENTION

Like prior manual air displacement pipettes, the present invention comprises a hand holdable pipette body housing and supporting a plunger unit for axial movement from a home position to an upper stop position and between the upper stop position and a lower stop position. The home position is between the upper and lower stop positions and is the starting position to which the plunger unit is returned for the start of each successive aspiration operation with the pipette.

Also as with prior manual air displacement pipettes, once a selected volume of liquid has been aspirated into a pipette tip secured to a lower end of the pipette by upward movement of the plunger unit from the home position to the upper stop position, the pipette user presses downward on a plunger control knob secured to an upper exposed end of the plunger unit to move the plunger unit downward from the upper stop position to the lower stop position wherein the selected volume of liquid contained in the pipette tip is expelled from the tip.

With the pipette of the present invention however, such aspiration and dispensing operations are free of the continuous upward forces generated by a conventional return spring and the relatively strong upward forces generated by a conventional blow out spring. That is because the improved manual air displacement pipette of the present invention does not include either a return spring or a conventional blow out spring. Rather, in the pipette of the present invention, the only force opposing axial movement of the plunger unit may be the sliding friction force generated by a piston seal necessary to the operation of an air displacement pipette. The seal friction force may be sufficient by itself to maintain the plunger unit at any axial position selected by the pipette user. Alternatively, the piston seal force may be supplemented by an additional friction force which may be selectable by the pipette user and when combined with the seal friction force will be sufficient to maintain the plunger unit at any axial position selected by the user.

Thus, a basic embodiment of the present invention may simply include a pipette body, a plunger unit, a piston seal and means for identifying to the pipette user the location of the home position for the plunger unit between an upper and lower stop.

In other embodiments of the present invention, a weak blow out spring may be added to locate the home position of the plunger unit while in still other embodiments, mechanical or magnetic detents may be included for that purpose.

Further, is some embodiments of the present invention, magnetic or mechanical detents may be included at the upper stop position to aid in the location of the plunger unit at the upper stop.

Still further, the pipette of the present invention may be of a fixed volume pipette or an adjustable volume pipette. The adjustable volume version of the pipette may include means for adjusting the axial position of an upper stop defining the selected volume for the pipette.

Other features of the pipette of the present invention will be appreciated from a reading of the following detailed description when taken with the drawings as described below.

BRIEF DESCRIPTION OF DRAWINGS

In FIG. 1, the pipette includes a relatively weak blow out spring as the indicating means while in FIG. 2 the pipette includes a detent means for such a purpose.

FIG. 9*a* depicts the actuating force associated with a standard manual air displacement pipette.

DETAILED DESCRIPTION OF INVENTION

Figure 1:
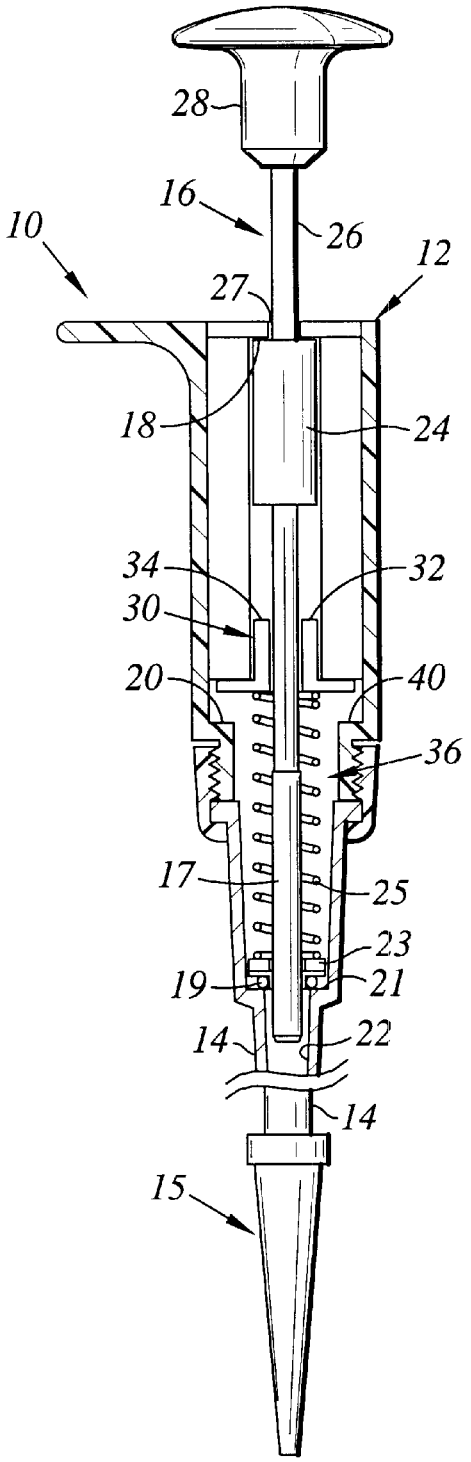
FIGS. 1 and 2 are diagrammatic sectional side views of a basic form of the manual air displacement pipette of the present invention including means for indicating to a pipette user the location of the home position for the plunger unit of the pipette.

Referring to FIG. 1, a basic form of the manual air displacement pipette of the present invention is diagrammatically illustrated and represented by the numeral 10. The pipette 10 comprises a pipette body or housing 12 preferably formed from a plastic material. The body 12 is axially elongated and shaped to be hand holdable with a liquid end or pipette tip mounting shaft 14 contiguous with and extending axially from a lower end of the body 12 to receive a disposable pipette tip 15. A plunger unit 16 is supported for axial movement within the pipette body 12 between an upper stop 18 and a lower stop 20.

As illustrated, the piston unit 16 includes a piston 17 at a lower end thereof. The piston 17 is axially received by an annular piston seal 19 which is seated on an annular shoulder 21 within the shaft 14. From the seal 19, the piston 17 extends axially into a cylinder 22 within the shaft 14 below the piston seal. The piston seal 19 is retained on the shoulder 21 by a seal retainer 23 and is compressed thereby to create a fluid tight sliding friction seal with the piston. The compression of the piston seal is in response to the downward spring force of a relatively weak blow out spring 25 extending vertically between the seal retainer 23 and the bottom of a hat shaped home position stop member 34. The blow out spring 25 is a weak spring relative to conventional blow out springs and only generates a spring force of about one (1) pound as compared to the eight (8) pounds of spring force generated by conventional blow out springs included in commercial manual air displacement pipettes.

At the upper stop 18, an upper end 27 of an enlarged plunger 24 of the plunger unit 16 engages the upper stop with an end portion 26 of the plunger unit 16 extending from an upper end of the pipette body 12 to receive a control knob or plunger button 28. The body 12 and plunger button 28 are shaped such that when a pipette user grips the body 12 and his or her thumb extends over the top of the button, downward thumb action of the user will exert a downward force on the plunger unit 16 to precisely move the plunger unit against the friction force of the piston seal 19 downward from the upper stop 18 to and through the home position for the plunger unit 16 toward the lower stop 20.

At the lower stop 20, a bottom stop member 30 (here the hat shaped home position stop 34 having a top surface 32), moveable with the plunger unit 16 below a home position for the plunger unit, engages an annular shoulder 40 within the pipette body 12 to limit further downward movement of the plunger unit within the pipette body and define the lower stop 20.

Alternatively, when the pipette user grips the pipette body 12 with his or her thumb below or to the side of the button 28, upward thumb action will exert an upward force on the plunger unit to precisely move the plunger unit upward, for example, from the lower stop or from the home position toward the upper stop 18 to aspirate a fluid into the tip 15.

Parenthetically, the "home" position is the axial position of the plunger unit 16 in the pipette body 12 between the upper and lower stops 18 and 20 where the pipette 10 is ready for its tip 15 to be immersed in a liquid for pickup by the pipette 10 and subsequent dispensing into a receptacle. It is also the return position for the plunger unit 16 during repeated pipette operations in drawing liquid into and dispensing liquid from a series of disposable tips such as the tip 15.

In the pipette of the present invention, the home position for the plunger unit is defined by a user sensitive mechanism 36 included within the pipette body 12. In the pipette of FIG. 1, the mechanism 36 comprises the lower end of the plunger 24 and the home position stop 34 supported by the weak blow out spring 25. As constructed, the mechanism 36 will provide the pipette user with a physical indication that the plunger unit has reached the home position when the lower end of the plunger 24 in moving downward with the plunger unit 16 engages top 32 of the home position stop 34. Thereafter, downward movement of the plunger unit 16 will be opposed by the seal friction of the piston seal 19 and the spring force of the weak blow out spring 25. Such an increase in the forces opposing downward movement of the plunger unit beyond the home position will also be an indication to the pipette user that the plunger unit is beyond the home position.

Figure 9A:
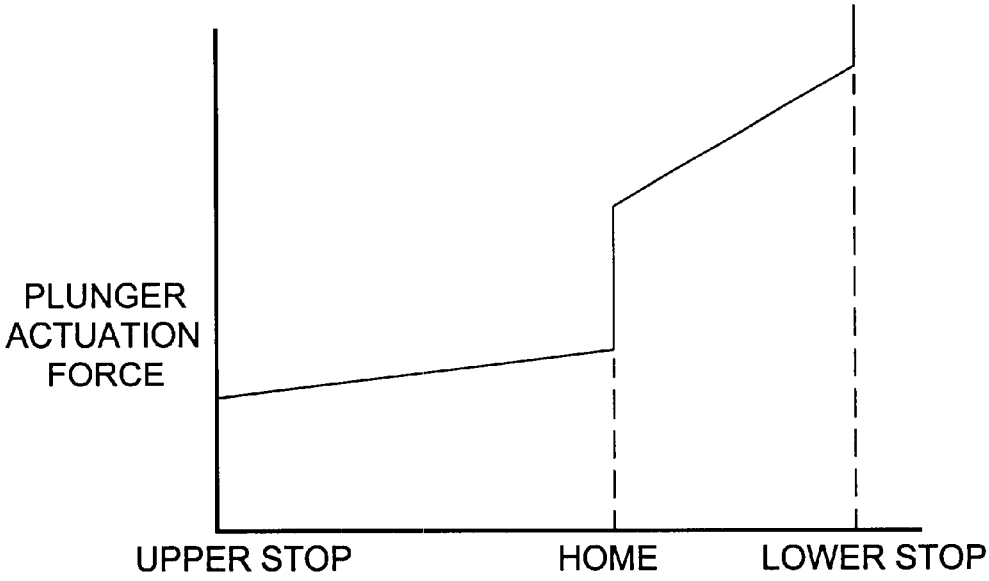
(PRIOR ART) Fig. 9a
FIGS. 9*a* and *b* are graphs depicting the magnitude of the actuating force which a pipette user must exert on a plunger unit in moving the plunger unit from its upper stop to its home position and then to its lower stop position.
Figure 9B:
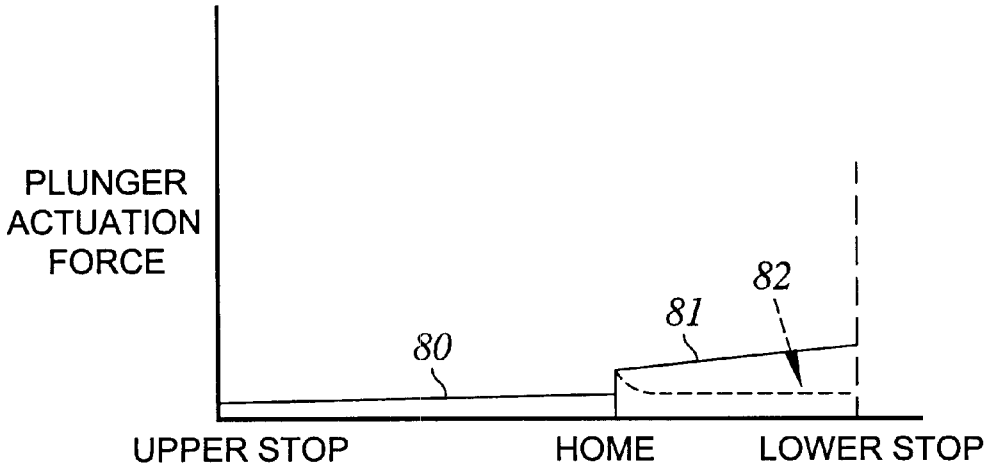
FIG. 9*b* depicts the actuating forces associated with the manual air displacement pipettes illustrated in FIGS. 1 and 2.

In the manual air displacement pipette of FIG. 1, the forces opposing axial movement of the plunger unit are minimal. The seal friction force is very small as is the spring force of the weak blow out spring 25. This results in an operating force profile for the pipette 10 which is much less that that associated with conventional commercially available manual air displacement pipettes including conventional return and blow out springs. Reference to the graphs of FIGS. 9*a* and 9*b* illustrate that point. In particular, FIG. 9*b* represents the plunger unit activation forces associated with the pipette of FIG. 1 while FIG. 9*a* depicts the plunger unit activation forces associated with prior art manual pipettes including conventional return and blow out springs. As depicted in FIG. 9*b*, as the plunger unit in the manual pipette of FIG. 1 is moved from its upper stop position, the manual force which the pipette user must generate is only the minimal force required to overcome the seal friction force of the piston seal 19 and is depicted at 80. As the plunger unit 16 reaches the home position and the plunger 24 engages the home position stop 34 that engagement is physically sensed by the pipette user as an indication that the piston unit is at its home position. Any further downward movement of the piston unit toward the lower stop 20 is also opposed by the small spring force of the weak blow out spring 25 resulting in an increase in the activation force which the user must generate in moving the plunger unit through blow out. This is depicted at 81 in FIG. 9*b* and is significantly less than the activation force for the conventional manual air displacement pipette depicted in FIG. 9*a*.

Figure 2:
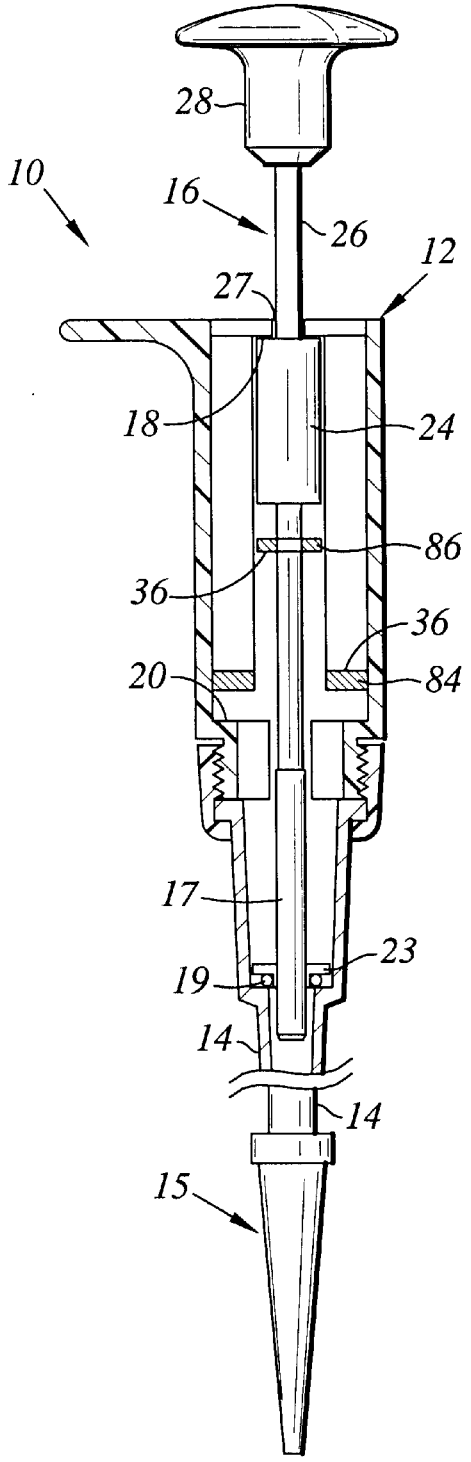

The activation forces associated with the pipette illustrated in FIG. 2 are even less than those associated with the pipette of FIG. 1. In that regard, the structure of the pipette of FIG. 2 is very similar to that shown and described with respect to FIG. 1 and corresponding components of the pipette of FIG. 2 bear the same reference numerals as the pipette of FIG. 1.

A major difference between the pipetters of FIG. 1 and FIG. 2 is that the pipette 10 of FIG. 2 does not include a blow out spring and utilizes a detent mechanism to indicate to the pipette user that the plunger unit has reached and is at the home position. Accordingly, for the pipette 10 of FIG. 2, the only force opposing axial movement of the plunger unit is the seal friction force associated with the piston seal 19 engaging the piston 17. A graph of the activation forces for the pipette of FIG. 2 therefore includes the curve 80 between the upper stop 18 and the home position. At the home position, the home position detent introduces a slight force change as the plunger unit 16 reaches its home position. Thereafter, as the plunger unit travels between the home position and the lower stop 20 to effect blow out only the seal friction forces of the piston seal oppose axial movement of the plunger unit by the pipette user. This is depicted by the dashed line 82 in FIG. 9*b*.

As shown diagrammatically in FIG. 2, the mechanism 36 comprises a first component 84 supported within the body 12 adjacent the plunger unit 16 and a second component 86 on the plunger unit. In these regards, the mechanism 36 may comprise a mechanical detent mechanism 36*a* as depicted generally in FIG. 3 or a magnetic detent mechanism 36*b* as depicted generally in FIG. 4.

Figure 3:
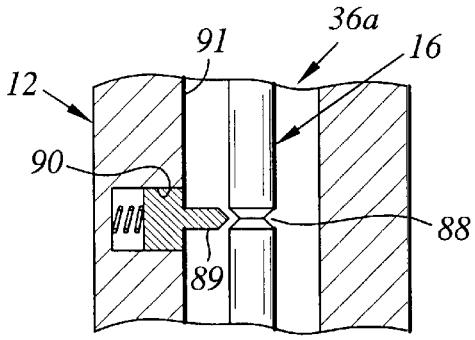
FIGS. 3 and 4 are diagrammatic fragmentary sectional side views of a mechanical and magnet detent mechanisms respectively, for use as the indicating means in the pipette of FIG. 2.

As depicted in FIG. 3, the mechanical detent 36*a* comprises a groove 88 in the plunger unit and a spring loaded plunger detent 89 extending from a cavity 90 in inner wall 91 of the pipette body 12. The plunger detent 89 rides on an outer surface of the plunger 24 and into the groove 88 to provide the pipette user with a physically sensed indication that the plunger unit has reached the home position.

Figure 4:
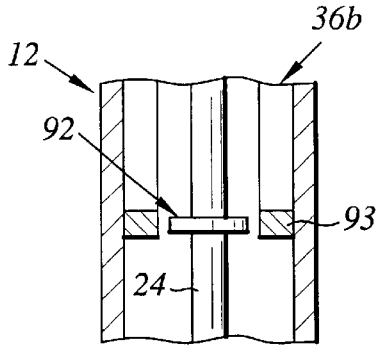

As depicted in FIG. 4, the magnetic detent 36*b* comprises a iron or steel member 92 on the plunger 24 and a ring magnet 93 axially receiving the plunger and secured to the inside of the pipette body 12. As the member 92 moves with the plunger 24 and approaches the ring magnet 93, a magnetic field force is exerted on the member 92 changing the forces opposing axial movement of the plunger unit. That change in axial forces is physically sensed by the pipette user as an indication that the plunger unit is at the home position. The activation force profile associated with the pipette of FIG. 2. including the mechanical or magnetic detents of FIGS. 3 and 4 is depicted by the dashed line 82 in FIG. 9*b*.

Figure 5:
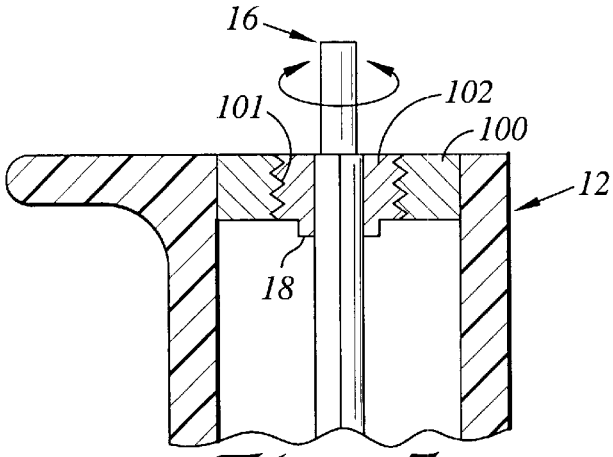
FIG. 5 is a diagrammatic sectional side view of a volume adjustment mechanism which may be included in the pipettes of FIGS. 1 or 2 to control the axial location of an upper stop whereby the pipette may become an adjustable volume rather than a fixed volume pipette.

The pipettes of FIGS. 1 and 2 are fixed volume pipettes. To render such pipette adjustable in volume it is preferable to render the upper stop 18 axially moveable within the pipette body 12. A mechanism for converting the fixed volume pipettes of FIGS. 1 and 2 to variable volume pipettes is illustrated diagrammatically in FIG. 5. As depicted, a top of the pipette body 12 receiving the plunger unit 16 fixedly receives a nut 100 including an internally threaded hole 101 receiving a tubular screw member 102 comprising the upper stop 18. The plunger 24 is non-circular, e.g. square or hexagonal and axially fits into a similarly shaped hole in the screw 102. Thus constructed, a hand turning of the plunger unit by the pipette user gripping the button 28 produces a like turning of the screw 102 in the nut. This causes the screw to move vertically relative to the nut to change the location of the lower surface of the screw in the pipette body to change the axial location of the upper stop 18. This allows the pipette user to control the volume of liquid which may be aspirated in the pipette tip 15 with movement of the plunger unit from the home position to the upper stop position.

Figure 6:
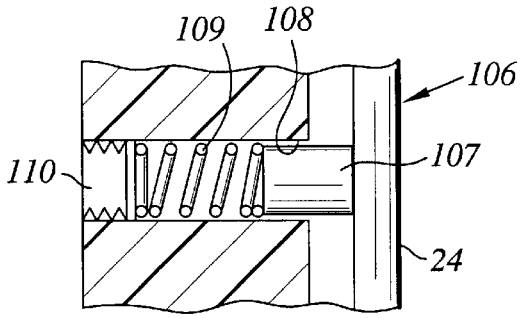
FIG. 6 is an enlarged diagrammatic fragmentary side view of a plunger friction unit for supplementing the piston seal friction force of the pipette of FIG. 1 or FIG. 2.

Not only may the volume of the manual pipette of one preferred embodiment be adjustable by the pipette user, but also the forces opposing axial movement of the pipette may be controlled by the pipette user. To accomplish this, one preferred embodiment of the pipette of the present invention may include an additional friction force generating mechanism such as the mechanism 106 shown in FIG. 6. This is particularly important if the seal friction provided by the piston seal is not adequate to maintain the plunger unit in any axial position selected by the pipette user during operation of the pipette. To insure that the plunger unit will remain at an axial position selected by the pipette user, the mechanism 106 comprises a friction pad 107 extending laterally from a cavity 108 in an inner sidewall of the pipette body to engage an outer surface of the plunger 24. The pad 107 is connected to a spring 109 seated in the cavity 108 to continuously urge the pad against the plunger. The spring force exerted by the spring 109 and hence the additional friction force on the plunger may be adjusted by the user turning a setscrew 110 in an end of the cavity. In this manner, the additional friction force may be tailored by the user to a value most suitable to the user.

Also, in another preferred embodiment of the pipette of the present invention, detents may be included to insure that the plunger unit 16 has reached and is at the upper stop 18. Magnetic and mechanical detent mechanisms 112 and 116 for such purposes are diagrammatically illustrated in FIGS. 7 and 8, respectively.

Figure 7:
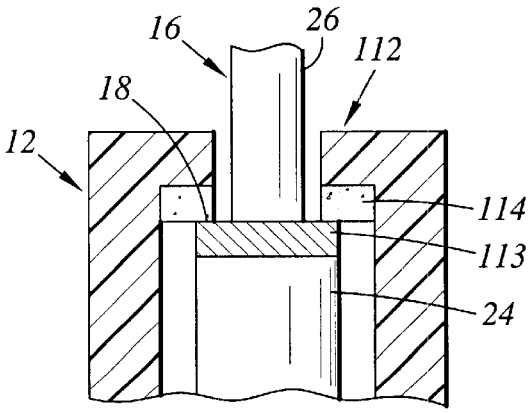
FIG. 7 is an enlarged diagrammatic fragmentary side view of a magnetic detent for upper stop in the manual pipette of FIG. 1 or FIG. 2.

The magnetic detent mechanism 112 shown in FIG. 7, for example, comprises an iron or steel ring 113 secured to a top of the plunger 24 and a ring magnet 114 secured to an underside of a top of the pipette body 12 around the access opening for the upper portion 26 of the plunger unit 16. Thus constructed, as the plunger unit 16 approaches the upper stop 18, the magnetic field generated by the magnet 114 attracts the ring 113 to releasably secure the ring to the magnet and the plunger unit at the upper stop 18.

Figure 8:
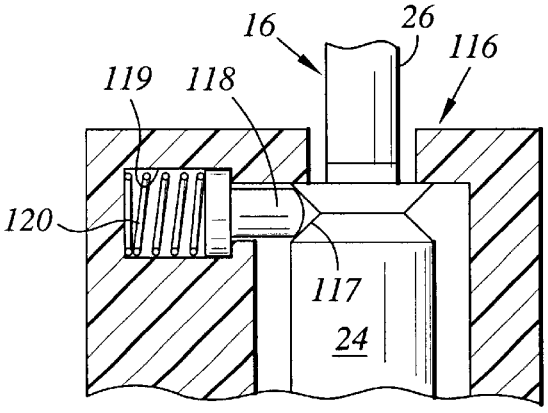
FIG. 8 is an enlarged diagrammatic fragmentary side view of a mechanical detent for the upper stop in the manual pipette of FIG. 1 or FIG. 2.

The mechanical detent mechanism 116 shown in FIG. 8, for example, comprises a lateral groove 117 around a top portion of the plunger, a plunger detent 118 extending laterally from a cavity 119 in an inner sidewall of the pipette body and a spring 120 in the cavity continuously urging the plunger detent against a side of the plunger. When the plunger unit reaches the upper stop 18, the plunger detent rides into the groove 117 to releasably secure the plunger unit at the upper stop.

From the foregoing, it should be appreciated that the elimination of the return spring places the plunger unit 16 of the manual air displacement pipette 10 of the present invention under the total control of the pipette user who can then with minute precision and with the use of minimal thumb of finger forces accurately control the upward and downward movement and location of the plunger unit during both liquid aspiration and dispensing operations, all free of the continuous upward forces of a conventional return spring. So precise is the operation of the pipette that even the tip of a drop of liquid can be easily aspirated and dispensed thereby.

Further, with the pipette of the present invention, the rate of upward and downward movement of the plunger unit is within the complete manual control of the pipette user. By the proper manual control of the rate of piston movements, problems associated with "fountaining" and the "aerosols" caused by too rapid movement of the plunger unit in conventional manual air displacement can be eliminated.

Still further, in the manual air displacement pipette of the present invention, the only force opposing user initiated axial movement of the plunger unit may be that of the piston seal 19 which creates the necessary fluid tight seal around the piston 17 of the plunger unit. Such seal friction is sufficient to hold the plunger unit in any axial position where it is located by the pipette user. Thus, for example, in the pipette of the present invention, once the pipette user manually moves the plunger to the home position, no further forces need be generated by the user to maintain the plunger unit at the home position.

Further, the seal friction force is so low that the upward thumb or finger force which must be generated by the pipette user to move the plunger from the home position to the upper stop position during aspiration of a selected volume of liquid or the downward force which must be generated to move the plunger unit to the lower stop position to dispense the selected volume of liquid from the pipette tip secured thereto, is absolutely minimal.

Also, during any such upward or downward plunger unit movement, the user may halt the movement of the plunger and it will remain at that location for adjustment by the user as during precision pipetting of minute liquid sample or the layering of gels or the loading of electrophoresis plates or any during any one of the several different modes of operation of the pipette, e.g. titration, measurement, multiple dispense and the like.

Thus, while like prior manual air displacement pipettes, the present invention (i) comprises a hand holdable pipette body supporting a plunger unit for axial movement from a home position to an upper stop position and between the upper stop position and a lower stop position and (ii) operates to aspirate a selected volume of liquid into a pipette tip secured to a lower end of the pipette by upward movement of the plunger unit from the home position to the upper stop position and to dispense the selected volume of liquid from the tip by movement of the plunger unit from the upper stop position to the lower stop position, with the pipette of the present invention such aspiration and dispensing operations are free of the continuous upward forces generated by a conventional return spring and the relatively strong upward forces generated by a conventional blow out spring. Rather, in the pipette of the present invention, the only force opposing axial movement of the plunger unit may be the sliding friction force generated by a piston seal necessary to the operation of an air displacement pipette. Alternatively, the piston seal force may be supplemented by an additional friction force which may be selectable by the pipette user and when combined with the seal friction force will be sufficient to maintain the plunger unit at any axial position selected by the user.

Thus, it should be appreciated from the foregoing detailed description that a basic embodiment of the present invention may simply include a pipette body, a plunger unit, a piston seal and means for identifying to the pipette user the location of the home position for the plunger unit between an upper and lower stop. In other embodiments of the present invention, however a weak blow out spring may be added to locate the home position of the plunger unit while in still other embodiments, mechanical or magnetic detents may be included for that purpose.

Further, in some embodiments of the present invention, magnetic or mechanical detents may be included at the upper stop position to aid in the location of the plunger unit at the upper stop.

Still further, the pipette of the present invention may be of a fixed volume pipette or an adjustable volume pipette. The adjustable volume version of the pipette may include means for adjusting the axial position of an upper stop defining the selected volume for the pipette.

Figure 10:
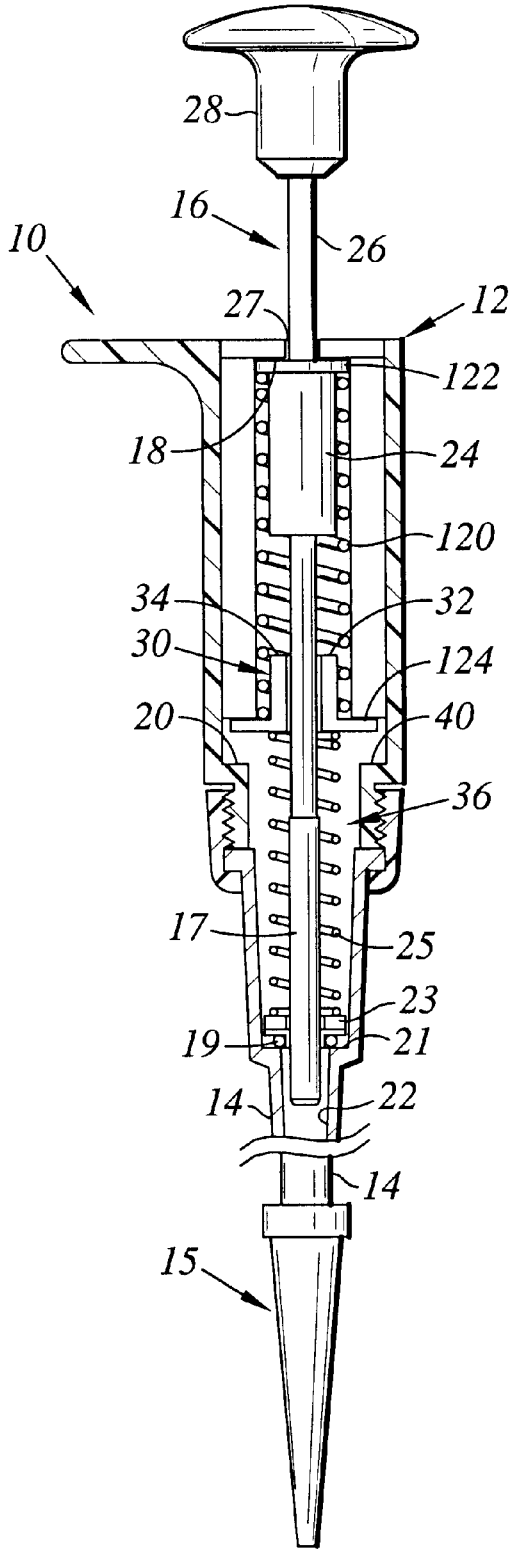
FIG. 10 is a diagrammatic sectional side view of another embodiment of a pipette similar to the basic embodiment shown in FIG. 1, with a relatively weak spring for assisting the pipette user in moving and positioning the plunger unit at a location between the upper stop and home positions.

While particular embodiments of the present invention have been illustrated and described hereinabove, it should be appreciated that changes and modifications may be made in the described embodiments without departing from the spirit of the present invention. For example, as shown in FIG. 10, a relatively weak coil spring 120 may be included to oppose the downward gravitational pull on the plunger unit 16 and to aid the piston seal 19 in maintaining the plunger unit at any axial position selected by the pipette user in moving the plunger unit between the home position and the upper stop position. Further, by exerting a small upward force on the plunger unit 16, the spring 120 may assist the pipette user in initially moving the plunger upward from the home position toward the upper stop position. In these regards, in the embodiment of FIG. 10, the coil spring 120 axially receives and coils around the enlarged plunger 24 of the plunger unit 16. At its upper end, the spring 120 engages an annular flange 122 secured to and extending radially from an upper end of the plunger 24. At its lower end the spring 120 engages and rests upon a flange portion 124 of the hat shaped home position stop 34.

Accordingly, the present invention is to be limited in its scope only by the following claims.

What is claimed is:

1. A fully manually controllable return springless manual air displacement pipette, comprising:

a hand holdable housing;

a plunger unit mounted for axial movement within the housing between upper and lower stops and a home position, the home position being a predetermined starting position for the plunger unit for a repeatable aspiration of a selected quantity of liquid into a tip extending from a pipette tip mounting shaft at a lower end of the pipette housing when the tip is immersed in the liquid and the lower stop defining an end position for the plunger unit at which substantially all liquid is dispensed by the pipette from the tip;

an upper end portion of the plunger unit extending vertically from the housing for thumb or finger contact by a pipette user to move the plunger unit axially and precisely within the housing between the upper and lower stops;

a piston extending from a lower end portion of the plunger unit through a fluid tight friction seal encircling the piston and into a cylinder within the pipette tip mounting shaft; and a spring mounted within the housing for exerting an upward force on the plunger unit as it moves between the home position and the upper stop and which is insufficient by itself to move the plunger unit upward from the home position to the upper stop upon a release of the plunger unit by the pipette user, whereby the pipette is return springless and the plunger unit is precisely manually moveable by the pipette user against the seal friction from the home position upward to the upper stop to aspirate the selected volume of liquid into the tip and is precisely manually moveable by the user against the seal friction downwardly from the upper stop to the lower stop to dispense the selected volume of liquid from the tip and is precisely manually moveable against the seal friction to the home position to return the plunger unit to its starting position for another aspiration of liquid into a tip secured to the mounting shaft.

2. The pipette of claim 1 further including a weak blow out spring which exerts an upward force on the plunger unit as it moves from the home position toward the lower stop to define pipette user sensitive means within the housing indicating to the user that the plunger unit is at the home position.

3. A fully manually controllable air displacement pipette free of any spring means capable of moving a plunger unit thereof from a home position to an upper stop upon a manual release of the plunger unit by a pipette user whereby the pipette is return springless, the pipette comprising:

a hand holdable housing;

a plunger unit mounted for axial movement within the housing between upper and lower stops with an upper end portion extending vertically from the housing for pipette user thumb or finger contact to move the plunger unit axially and precisely within the housing between the upper and lower stops, and a piston extending from a lower end portion of the plunger unit through a fluid tight friction seal encircling the piston and into a cylinder within a pipette tip mounting shaft at a lower end of the housing for receiving a pipette tip into which liquid is aspirated and from which liquid is dispensed by operation of the pipette;

pipette user sensitive means within the housing defining a home position for the plunger unit between the upper and lower stops, the home position being a predetermined starting position for the plunger unit for aspiration of a selected volume of liquid into the pipette tip; and a spring mounted within the housing for exerting an upward force on the plunger unit as it moves between the home position and the upper stop and which is insufficient by itself to move the plunger unit upward from the home position to the upper stop upon a release of the plunger unit by the pipette user, whereby the pipette is return springless and the plunger unit is precisely manually moveable by the pipette user against the seal friction from the home position upward to the upper stop to aspirate the selected volume of liquid into the tip and is precisely manually moveable by the user against the seal friction downwardly from the upper stop to the lower stop to dispense the selected volume of liquid from the tip and is precisely manually moveable against the seal friction to the home position to return the plunger unit to its starting position for another aspiration of liquid into a tip secured to the mounting shaft.

* * * * *